US007121534B2

(12) United States Patent
Dyson

(10) Patent No.: US 7,121,534 B2
(45) Date of Patent: Oct. 17, 2006

(54) METHOD AND APPARATUS FOR GASIFYING A LIQUID

(75) Inventor: Claude Dyson, Merseyside (GB)

(73) Assignee: Dyhaw Limited, Manchester (GB)

( * ) Notice: Subject to any disclaimer, the term of this patent is extended or adjusted under 35 U.S.C. 154(b) by 0 days.

(21) Appl. No.: 10/481,493

(22) PCT Filed: Jun. 19, 2002

(86) PCT No.: PCT/GB02/02816

§ 371 (c)(1),
(2), (4) Date: May 12, 2004

(87) PCT Pub. No.: WO03/000391

PCT Pub. Date: Jan. 3, 2003

(65) Prior Publication Data

US 2004/0183218 A1 Sep. 23, 2004

(30) Foreign Application Priority Data

Jun. 21, 2001 (GB) ..... 0115111.7

(51) Int. Cl.
*B01F 3/04* (2006.01)

(52) U.S. Cl. ..... 261/74; 261/112.1; 261/120

(58) Field of Classification Search ..... 261/74, 261/108, 112.1, 120, 119.1, DIG. 44; 96/324, 96/327, 328

See application file for complete search history.

(56) References Cited

U.S. PATENT DOCUMENTS

| | | | | | |
|---|---|---|---|---|---|
| 1,128,548 | A | * | 2/1915 | Sykes | 96/271 |
| 1,762,126 | A | | 6/1930 | Smith | |
| 1,905,422 | A | * | 4/1933 | Rasmussen | 261/112.1 |
| 2,172,646 | A | * | 9/1939 | Walker | 261/36.1 |
| 2,180,586 | A | * | 11/1939 | Gustafsson | 96/228 |
| 3,122,126 | A | | 2/1964 | Yamada | 119/3 |
| 3,386,229 | A | * | 6/1968 | Reed | 96/262 |
| 3,795,093 | A | * | 3/1974 | Gerhard et al. | 96/316 |
| 3,840,216 | A | * | 10/1974 | Smith et al. | 261/29 |
| 3,876,399 | A | * | 4/1975 | Saponaro | 96/238 |
| 3,998,389 | A | * | 12/1976 | Rose et al. | 239/214.21 |
| 4,009,229 | A | * | 2/1977 | Szucs et al. | 261/72.1 |
| 4,540,528 | A | * | 9/1985 | Haegeman | 261/91 |
| 4,608,064 | A | * | 8/1986 | Napadow | 96/307 |
| 4,734,235 | A | * | 3/1988 | Holyoak | 261/91 |
| 4,836,142 | A | | 6/1989 | Duback | 119/5 |
| 4,885,010 | A | * | 12/1989 | Rich et al. | 96/271 |
| 5,545,239 | A | * | 8/1996 | Cordier | 96/228 |
| 5,571,409 | A | | 11/1996 | Scarborough | 210/169 |
| 5,707,562 | A | * | 1/1998 | Karliner | 261/91 |

(Continued)

FOREIGN PATENT DOCUMENTS

| | | |
|---|---|---|
| FR | 2016925 | 5/1970 |

(Continued)

OTHER PUBLICATIONS

Search Report dated Oct. 9, 2001 in connection GB 0115111.7.

*Primary Examiner*—Scott Bushey
(74) *Attorney, Agent, or Firm*—Charles N. Quinn

(57) ABSTRACT

A method and apparatus for gasifying a liquid wherein a liquid feedstock (2) to be gasified is passed down a surface (8) in the presence of a gas and into standing liquid (6), the surface having at least one change in gradient (8*a*, 8*b*) to provide a surface for the development of turbulence which is essential in drawing gas into the liquid.

23 Claims, 2 Drawing Sheets

U.S. PATENT DOCUMENTS

Figure 1:
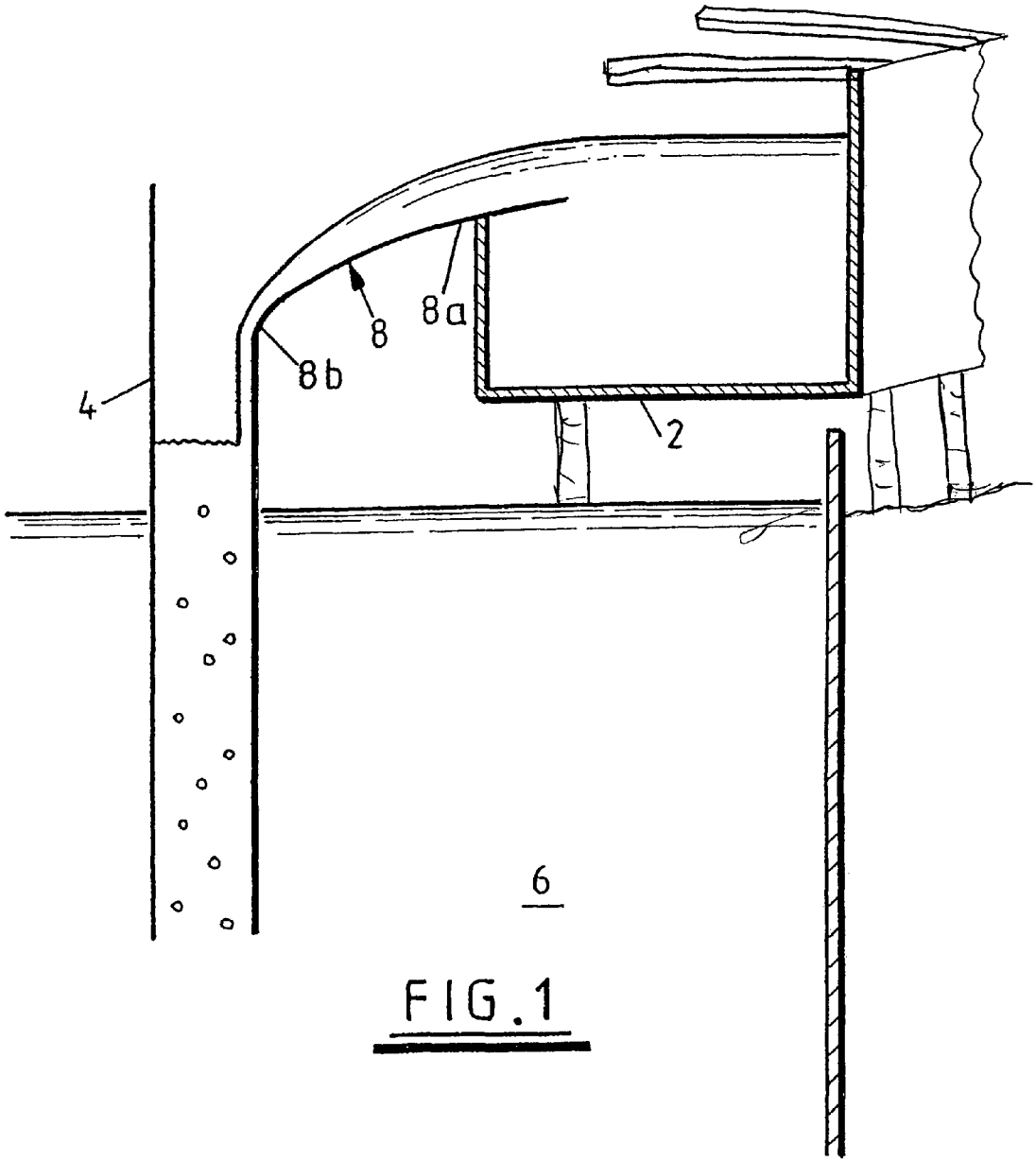

| | | | | |
|---|---|---|---|---|
| 5,799,609 | A | 9/1998 | Burns et al. | 119/74 |
| 5,846,303 | A * | 12/1998 | Milojevic | 96/323 |
| 6,508,163 | B1 * | 1/2003 | Weatherill | 99/323.1 |

FOREIGN PATENT DOCUMENTS

| | | |
|---|---|---|
| FR | 2687046 | 8/1993 |
| GB | 2079167 | 1/1982 |
| GB | 2185541 | 7/1987 |
| JP | 06206091 | 7/1994 |

* cited by examiner

METHOD AND APPARATUS FOR GASIFYING A LIQUID

The present invention relates to an improved method and apparatus for gasifying a liquid, for example for aerating still waters in a dock or the like.

It is known to provide apparatus for combining a liquid and a gas. For example, U.K. Patent No. 1484657 describes an apparatus comprising a circulating pump for withdrawing liquid from a tank, an injector pump having a nozzle through which liquid is directed and a gas inlet. Gas introduced via the inlet is carried along in the flow of the liquid as it leaves the injector pump nozzle. The liquid having the entrained gas is then re-introduced into the tank close to the bottom thereof and the gas bubbles float upwardly in the tank. However, the introduction of a gas into the base of a tank holding the liquid has a short contact period as the bubbles rise quickly to the surface due to buoyancy.

Co-current downflow contactor columns, which are designed to extend the contact time usually apply sparger type devices or venturi contractions near the free surface. U.K. Patent No. 2079167 describes a method and apparatus for gasifying a liquid wherein the bubbles are generated naturally, the resulting two-phase mixture descending a suitably proportioned column. A jet of liquid is passed, in the presence of the gas, down a surface of a sufficient length in the direction of flow to cause the flowing liquid to achieve an equilibrium condition in which there is no further change in its velocity or in its thickness as measured normal to the surface; the solid boundary being such that turbulence is induced in the flowing liquid at least when it achieves the equilibrium condition. Liquid gasified in one run down the surface may be further gasified by a second or subsequent run, with the frequency of recycling depending upon the amount of gasification to be effected; the maximum time being that at which the liquid is incapable of taking up more gas. The aforementioned method and apparatus is particularly useful for aerating sewage sludge.

A jet of water travelling freely through a gas, such as air will create a zone of disturbance when it enters a volume of standing water. Some jets introduce considerable volumes of air into this region whilst others do not. It has been established that only a jet whose surface is rough is capable of taking any air down in the water. The flow condition of such a jet is technically described as "turbulent".

Turbulence can be defined as random transverse oscillations imposed on the general motion of a fluid usually initiated where the fluid moves on to a solid surface. The development is progressive. The volume of liquid influenced increases in thickness normal to the solid boundary or surface and with distance along, ultimately reaching a free surface of the liquid. The free surface beyond this point is rough, and gas in contact is moved along with the liquid, the amount increasing with length of the rough surface.

In U.K. Patent No. 2079167 the jet of liquid introduced is in contact with a totally vertical wall. Therefore, for much of this vertical distance, turbulent conditions are developing and no gas movement is initiated because the jet is smooth. The energy required for this operation is indicated by the loss of potential energy of the liquid represented by the difference in height from the feed tank to the surface of the liquid in the conduit. Thus, a significant proportion of the potential energy is expended without influencing gas entrainment and is lost to the system.

It is desirable to obtain a high rate of gas entrainment by the liquid using as much of the potential energy of the jet of liquid as possible.

It is an aim of the present invention to provide an improved method for gasifying a liquid that is more energy efficient than methods described prior hereto.

A further aim of the present invention is provide an improved apparatus for gasifying a liquid that is of higher efficiency than apparatuses described prior hereto.

Accordingly, a first aspect of the present invention provides a method for gasifying a liquid, the method comprising passing liquid feedstock to be gasified down a surface in the presence of a gas and into standing liquid, one side of the flowing liquid being bounded by a solid surface provided by a side of a column that extends into the standing liquid and the other side of the liquid being bounded by an interface with a gas that occupies the rest of the column such that gas is drawn into the standing liquid, the movement of feedstock on the surface being such as to generate turbulence in the liquid feedstock, characterized in that the liquid feedstock is passed along a surface having at least one change in gradient for at least part of its downward flow to the standing liquid.

A second aspect of the present invention provides an apparatus for gasifying a liquid feedstock, the apparatus comprising a vessel for containing a standing liquid, a column extending into said vessel and being arranged so that liquid feedstock can be deposited thereon to cause the feedstock to flow therealong and into the standing liquid, the flowing liquid feedstock being bounded on one side by a solid surface provided by said column and on the other by an interface with a gas with which the feedstock is to be gasified that occupies the rest of the column characterized in that the apparatus includes a solid surface that has at least one change in gradient over which said liquid feedstock flows.

Preferably, the change in gradient is provided by a surface that is arcuate in profile. The change in profile provides a rough surface for the development of turbulence which assists in drawing gas into the liquid. Alternatively, the surface may have a single change of gradient, for example at a 90° angle. Preferably, the surface is substantially horizontal near to or at the entry point of the liquid feedstock to the surface and becomes substantially vertical near to or at the entry of the vessel.

The surface that has at least one change in gradient may be provided by the inner side of the column or be, for example in the form of a bridging member over which the liquid feedstock flows into a column stood in the vessel. The liquid feedstock may be supplied from a separate header vessel situated at a higher level relative to the main holding vessel.

The column is preferably of rectangular cross-section. Preferably, the liquid feedstock is fed to only one face of the column. Alternatively, circular columns or other types of delivery conduits may be used.

Preferably, liquid feedstock is introduced at the top of the column and a further inlet is provided for admitting gas into the column. A preferred gas is air or oxygen to provide aeration of the standing liquid in the vessel.

It is to be appreciated that the vessel may be any suitable container for holding liquid no matter how large or small. For example, the vessel may be in the form of a dock or a sewage tank.

The flow rate of the liquid and the cross-sectional area of the column are preferably proportioned so that the gas bubbles entrained in the liquid and carried down by the liquid can dissolve therein. The mass of gas dissolved depends on these factors and increases with the length of the turbulent jet and with the height of the surface and/or column over which the liquid feedstock is passed.

Whilst descending the column, the gas will be dissolved in the liquid and other gases already dissolved therein may possibly be ejected into the bubbles. These gases may be discharged directly into the vessel or may be discharged through an orifice provided in a separator. A through pipe may be attached to the separator for discharging the liquid from the separator at some other location.

The feedstock may be withdrawn from the vessel in which said surface is positioned so that gasified feedstock is conveyed back to said surface. Circulation of the feedstock may be continued until the entirety of the feedstock in the vessel has been gasified to the extent required. Conveying means, such as a pump, may be provided for circulation of the liquid feedstock.

The width of the column will depend upon the particular application of the method and apparatus. For example, columns having widths between 30 mm and 1000 mm have been used. Any suitable rate of flow of liquid may be used, for example 6 liters per minute or more than 20 liters per second.

It is to be appreciated that the column or member that provides a change in gradient, such as by means of an arcuate surface may be supported by suitable means to retain this profile or may be made of a rigid material which maintains its shape.

The surface and/or column may be suspended in a vessel, such as a tank or fermenter or may be mounted on a floating platform on a large body of water. Preferably, a pump is provided to raise the standing liquid to the top of the column/surface or header tank at an appropriate rate. Preferably, the apparatus is wind-powered.

Figure 2:
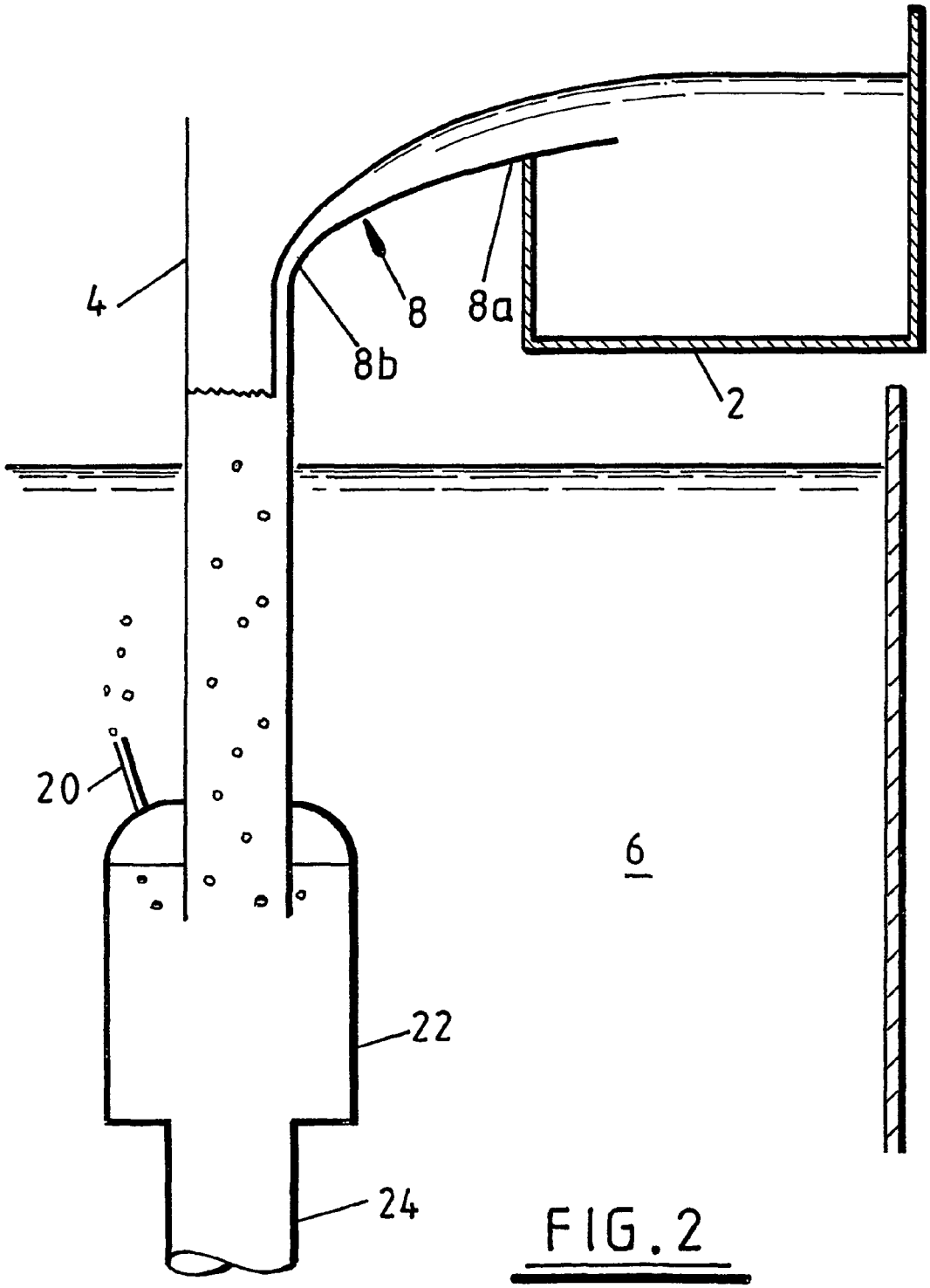

For a better understanding of the present invention and to show more dearly how it may be carried into effect, reference will now be made by way of example only to the accompanying drawings in which:

FIG. 1 is a diagrammatic sketch of an apparatus according, to one embodiment of the present invention; and FIG. 2 is a diagrammatic sketch of an apparatus according to another embodiment of the present invention.

Referring to FIG. 1 of the accompanying drawing, an apparatus for gasifying a liquid according to one embodiment of the present invention is illustrated. The apparatus comprises a header tank 2 for temporarily storing liquid, a contactor column 4 suspended in a tank 6. Liquid is supplied by suitable means (not shown), such as a pump, to the header tank and is discharged on to a plane surface provided by a bridging member 8 which is initially nearly horizontal 8*a* but which increases in gradient to vertical 8*b* to merge into the top of the contactor column.

The liquid that flows down the vertical wall of the contactor column enters liquid that is already present in the column and gas is drawn in and bubbles are formed. The flow rate of the liquid and the cross sectional area of the contactor are proportioned such that gas bubbles are carried down by the liquid and the gas can dissolve in the liquid. The mass of gas dissolved depends upon these factors and increases with the height of the contractor column.

In the present invention, the flowing liquid is bounded on one side by a solid surface and on the other by an interface with a gas. Whilst the solid boundary need not be a rough surface, the present invention provides a rough interface since without this no, or minimal, entrainment will take place. The rough surface drags adjacent air along and, ultimately, takes the adhering air (or gas) beneath the surface of the standing water.

The enhanced liquid together with depleted gas bubbles can be discharged into a large body of liquid. For example, the contactor column 4 may be suspended in a tank or fermenter or mounted on a floating platform on a large body of water, a pump raising liquid an appropriate rate.

Alternatively, if required, the gas bubbles can, be discharged through an orifice 20 in a separator 22, the liquid only passing through pipe 24 for discharge at some other location, as illustrated in FIG. 2 of the accompanying drawings. The bubbles are likely to be composed of a mixture of gas introduced at the top but not dissolved, and gases generated by chemical/physical activities in the contactor column.

The arcuate shape of the vertical side of the column causes the turbulent conditions to develop along the essentially horizontal part with minimum loss of potential energy and thus the invention is more energy efficient. It is preferred that the contactor column is a rectangular section, with fluid flowing down one face only, although flow down other faces is possible. It is to be appreciated that a circular or annular column could be used but at some loss in efficiency.

In one Example, using tap water and air, aerating columns were operated with voids between 25 and 35% and air and water throughput ratios of between 0–33%, at atmospheric pressure. Transfer rates of between 30–90% of the oxygen content of the air injected were measured with efficiencies as great as 5 kg per kW hour hydraulic input, depending upon the oxygen deficiency of the ambient water. Column widths of 30 mm to 1000 mm were used with flow rates ranging from 6 liters per minute to more than 20 liters per second.

The invention claimed is:

1. A method for gasifying a liquid, the method comprising passing liquid feedstock to be gasified down a plane surface in the presence of a gas and into a standing liquid, one side of the flowing liquid being bounded by a solid surface provided by a side of a column that extends into the standing liquid and the other side of the liquid being bounded by an interface with a gas that occupies the rest of the column such that gas is drawn into the standing liquid, the movement of feedstock on the surface of the column being such as to generate turbulence in the liquid feedstock characterized in that the liquid feedstock is passed along a plane surface of progressively increasing gradient for at least part of its downward flow into the standing liquid.

2. A method as claimed in claim 1 wherein the liquid feedstock is passed over a substantially horizontal surface and a substantially vertical surface before entering the standing liquid.

3. A method as claimed in claim 2 wherein the feedstock is withdrawn from a vessel in which said surface is positioned so that gasified feedstock flows from said surface back into said vessel.

4. A method as claimed in claim 3 wherein feedstock is passed over a side of the column that provides the surface of progressively increasing gradient.

5. A method as claimed in claim 4 wherein the feedstock is passed over a bridging member that provides a surface of progressively increasing gradient.

6. A method as claimed in claim 5 wherein the gas is discharged directly into the vessel containing the standing liquid.

7. A method as claimed in claim 6 further comprising conveying liquid from the vessel to the surface.

8. A method as claimed in claim 7 wherein the conveying means is a pump.

9. A method as claimed in claim 8 wherein the gas is air or oxygen to aerate the standing liquid.

10. An apparatus for gasifying a liquid feedstock, the apparatus comprising a vessel for containing standing liquid, a column extending into said vessel and being arranged so that liquid feedstock can be deposited thereon to cause the feedstock to flow therealong into the standing liquid, the flowing liquid being bounded on one side by a solid surface provided by said column and on the other by an interface with a gas with which the feedstock is to be gasified that occupies the rest of said column, characterized in that the apparatus includes a solid plane surface of progressively increasing gradient over which said liquid feedstock flows.

11. An apparatus as claimed in claim 10 wherein the progressively increasing gradient is provided by a surface that is accurate in profile.

12. An apparatus as claimed in claim 10 wherein the solid surface is substantially horizontal near or at the entry point of the liquid feedstock to the surface and becomes substantially vertical near to or at the entry of the vessel.

13. An apparatus as claimed in claim 12 wherein the surface having a progressively increasing gradient is provided by a side of the column.

14. An apparatus as claimed in claim 13 wherein the column is rectangular.

15. An apparatus as claimed in claim 14 wherein the liquid feedstock is fed to one face of said column.

16. An apparatus as claimed in claim 12 wherein the surface having a progressively increasing gradient is provided by a bridging member.

17. An apparatus as claimed in claim 16 wherein a header tank is provided for holding the liquid feedstock prior to depositing the feedstock on the surface.

18. An apparatus as claimed in claim 17 wherein the vessel is a dock.

19. An apparatus as claimed in claim 17 wherein the vessel is a sewage tank or fomenter.

20. Apparatus for gasifying a liquid feedstock, comprising a vessel for containing a standing liquid, a column extending into the vessel and being arranged so that liquid feedstock can be deposited thereon to cause the feedstock to flow therealong into the standing liquid, the flowing liquid being bounded on one side by a solid surface provided by the column and on the other by an interface with a gas with which the feedstock is to be gasified, that occupies the rest of said column, with the apparatus including a solid plane surface of progressively increasing gradient over which said liquid feedstock flows, wherein the solid plane surface is substantially horizontal near or at the entry point of the liquid feedstock to the surface and becomes substantially vertical near to or at the entry of the vessel, wherein the solid plane surface has a progressively increasing gradient provided by a bridging member, further wherein a header tank is provided for holding the liquid feedstock prior to depositing the feedstock on the surface, wherein the vessel is a sewage tank or fomenter, and further comprising a floating platform from which the column and the solid plane surface having a progressively increasing gradient are suspended in the standing liquid.

21. An apparatus as claimed in claim 19 wherein an orifice is provided in a separator provided in the vessel for discharging bubbles collected in the liquid feedstock.

22. An apparatus as claimed in claim 21 further comprising conveying means for delivering liquid from the vessel to said surface.

23. An apparatus as claimed in claim 22 wherein the conveying means is a pump.

* * * * *